US008469083B2

(12) United States Patent
Jainek et al.

(10) Patent No.: US 8,469,083 B2
(45) Date of Patent: Jun. 25, 2013

(54) HEAT EXCHANGER WITH BYPASS VALVE

(75) Inventors: Herbert Jainek, Heilbronn (DE); Alexander Wöll, Calw (DE)

(73) Assignee: Mann+Hummel GmbH, Ludwigsburg (DE)

( * ) Notice: Subject to any disclaimer, the term of this patent is extended or adjusted under 35 U.S.C. 154(b) by 734 days.

(21) Appl. No.: 12/605,323

(22) Filed: Oct. 24, 2009

(65) Prior Publication Data

US 2010/0116465 A1 May 13, 2010

(30) Foreign Application Priority Data

Oct. 24, 2008 (DE) ..... 20 2008 014 212 U

(51) Int. Cl.

| | |
|---|---|
| ***F28F 27/00*** | (2006.01) |
| ***F28D 1/00*** | (2006.01) |
| ***B01D 35/02*** | (2006.01) |
| ***B01D 35/147*** | (2006.01) |

(52) U.S. Cl.

USPC ..... 165/280; 165/279; 165/51; 165/119; 165/916; 236/34.5; 184/6.22; 184/104.3; 210/149; 210/167.06; 210/175; 210/186; 210/254; 123/196 AB

(58) Field of Classification Search

USPC ..... 165/103, 119, 138, 279, 280, 287, 165/297, 300, 916, 51; 210/167.05, 167.06, 210/167.32, 175, 184, 186, 767, 149, 254; 29/890.031; 236/34.5; 184/6.22, 104.3; 123/196 AB

See application file for complete search history.

(56) References Cited

U.S. PATENT DOCUMENTS

| | | | | |
|---|---|---|---|---|
| 3,743,011 | A * | 7/1973 | Frost | 165/283 |
| 4,783,271 | A * | 11/1988 | Silverwater | 210/742 |
| 4,991,643 | A * | 2/1991 | Price et al. | 165/283 |
| 5,098,559 | A * | 3/1992 | Mack et al. | 210/130 |
| 5,351,664 | A * | 10/1994 | Rotter et al. | 123/196 AB |
| 5,520,801 | A * | 5/1996 | Gerber et al. | 210/130 |
| 5,814,215 | A * | 9/1998 | Bruss et al. | 210/130 |
| 6,263,960 | B1 * | 7/2001 | Yamanaka et al. | 165/119 |
| 6,558,536 | B2 * | 5/2003 | Jainek et al. | 210/184 |
| 6,685,829 | B1 * | 2/2004 | Baumann et al. | 210/232 |
| 6,994,784 | B2 * | 2/2006 | Jainek | 210/149 |
| 7,306,030 | B2 * | 12/2007 | Luvisotto et al. | 165/284 |
| 7,997,505 | B2 * | 8/2011 | Martin et al. | 236/34.5 |
| 8,057,687 | B2 * | 11/2011 | Jainek | 210/767 |
| 2003/0132147 | A1 * | 7/2003 | Rosendahl et al. | 210/130 |
| 2004/0182566 | A1 * | 9/2004 | Jainek | 165/300 |
| 2008/0060991 | A1 * | 3/2008 | Gaither | 210/424 |

FOREIGN PATENT DOCUMENTS

WO WO 2006094996 A1 * 9/2006

* cited by examiner

*Primary Examiner* — John Ford

(57) ABSTRACT

A heat exchanger for cooling a liquid has an inlet and an outlet for a liquid to be cooled. A bypass is provided that bypasses the heat exchanger. A valve controls flow of liquid into the heat exchanger or into the bypass. The valve has a valve seat, a valve cone, and at least one spring made of a shape memory material. The at least one spring counteracts a liquid pressure existing in the inlet.

19 Claims, 5 Drawing Sheets

HEAT EXCHANGER WITH BYPASS VALVE

CROSS REFERENCE TO RELATED APPLICATIONS

Priority is claimed based on Federal Republic of Germany patent application no. DE202008014212.1, filed Oct. 24, 2008, the entire disclosure of which is incorporated herein by reference.

TECHNICAL FIELD

The present invention relates to a liquid filter, heat exchanger and bypass valve assembly.

BACKGROUND OF THE INVENTION

In internal combustion engines a heat exchanger can be used in order to cool the lubricating oil of the internal combustion engine. The heat exchanger includes usually a heat exchanging element and an inlet as well as an outlet for the lubricating oil as well as an inlet and an outlet for a cooling liquid. The heat exchanger is usually connected by the lubricating oil circulation to a liquid filter. The liquid filter can be arranged remote from the heat exchanger or can be directly integrated into the heat exchanger unit. The entire heat exchanger is connected by a flange to an engine block wherein the unfiltered heated raw oil is introduced from the engine block through an inlet first into the heat exchanger and is cooled therein and subsequently leaves the heat exchanger through an outlet. Subsequently, the oil can be supplied to the dirty side of the filter element and can be filtered by the filter element. Through the clean side of the filter element the filtered and cooled oil is returned into the oil circulation in the engine block. The heat exchanger can be arranged also at the clean side of the filter.

In order to prevent that in particular after a cold start of the engine at very low temperatures the oil flowing into the heat exchanger as a result of its greatly increased viscosity at low temperatures causes blockage and makes more difficult stationary flow through the heat exchanger, a bypass can be branched off, for example, from the inlet into the heat exchanger and extend to the outlet of the heat exchanger or, in case of an existing filter, it may connected directly to the dirty side of the filter. The bypass can be open independent of the operating state and throttled by a constriction. Other heat exchangers include a pressure relief valve that usually is in the closed position and therefore blocks the bypass. When the pressure surpasses a permissible limit, for example, at low temperatures as a result of a blocked heat exchanger, the pressure relief valve opens and the oil can flow out directly. In this way, a blocked heat exchanger does not block the entire liquid circulation. In this way, in particular an improved cold start behavior is achieved.

DE 102 45 005 A1 discloses a liquid filter heat exchanger unit in which a bimetal element, depending on the temperature of the liquid, controls the flow into the heat exchanger or through the bypass in that when a specific switching temperature is surpassed or undershot, it automatically switches between two switching positions: it opens the bypass below the switching temperature and closes it above the switching temperature.

A disadvantage of this solution is that it enables only a relatively minimal flow rate while a great flow resistance is present. Also, this solution is not capable of opening the bypass in case of overpressure at high operating temperatures.

DE 102 05 518 discloses a thermostat-controlled valve with integrated bimetal element in which the bimetal element opens the valve cone when a certain limit temperature is reached.

A disadvantage of this solution is that, in comparison to a pure pressure-control valve, it requires the bimetal element as an additional component. Moreover, it enables only a minimal switching travel.

U.S. Pat. No. 6,746,170 discloses an oil module for an internal combustion engine in which a bypass is controlled by a thermostat valve that comprises a spring of a shape memory material and a counteracting conventional spring. In this connection, the conventional spring acts as a restoring spring for the shape memory spring. In this connection, the spring made of shape memory material acts in the same direction as the liquid pressure at the dirty side, the conventional spring acts opposite to the liquid pressure and provides the force for opening the valve.

Based on this prior art knowledge, it is an object of the present invention to provide a heat exchanger that improves the cold start behavior of an internal combustion engine.

In particular, the present invention has the object to configure a heat exchanger with constructively simple measures and without controlling action from the exterior in such a way that at low temperatures and minimal liquid pressure a bypass is opened and with open bypass a higher volume flow through the bypass is enabled and the flow resistance is lowered.

SUMMARY OF THE INVENTION

In accordance with the present invention, this is achieved in that the heat exchanger for cooling a liquid, in particular in connection with motor vehicles, comprises an inlet and an outlet for the liquid to be cooled as well as a bypass that bypasses the heat exchanger and a valve for controlling the flow of liquid into the heat exchanger or into the bypass, wherein the valve has a valve seat, a valve cone, and at least one spring made of a shape memory material that counteracts the liquid pressure in the inlet.

The invention therefore concerns a heat exchanger, in particular for motor vehicles, for cooling a liquid. It comprises an inlet and an outlet for the liquid to be cooled as well as a bypass that connects the inlet to the outlet passage by bypassing the heat exchanger, and a valve for controlling the liquid flow into the heat exchanger and/or into the bypass.

In an advantageous embodiment, the valve comprises a spring of a shape memory material for controlling the flow of liquid into the heat exchanger and/or into the bypass. It can counteract the liquid pressure in the inlet passage.

The advantage of integrating a spring of shape memory material into the valve is that in this way the opening pressure of the valve becomes dependent on the temperature so that in a simple way a temperature-dependent and a pressure-dependent control of the throughput is realized.

In one embodiment the heat exchanger comprises a flange that serves for attaching the unit to the engine block and has inlet and outlet passages that can be connected to corresponding passages of the engine block.

The heat exchanger can optionally comprise an integrated liquid filter that serves for filtering the liquid.

In one embodiment a valve is provided in or upstream or downstream of the bypass that, by bypassing the heat exchanger, can connect the inlet of the heat exchanger with the outlet of the heat exchanger.

The bypass can extend also immediately from the inlet of the heat exchanger to the dirty side or to the clean side of a filter element of the liquid filter that is integrated into the heat exchanger.

In one embodiment, the bypass is arranged in an assembly together with the heat exchanger. This enables advantageously a high level of integration.

In one embodiment, the bypass is arranged separate from the assembly of the heat exchanger, for example, in the engine block, in particular in the crankcase, in the oil pan or in the cylinder head cover or, for example, is arranged separately in the engine compartment.

The valve may advantageously include a valve seat, a valve cone and at least one spring that effects closure of the valve wherein at least one spring is comprised of a shape memory material (for example, of a metal or metal alloy or a shape memory polymer; the material including any of, for example, nickel titanium, copper zinc, copper zinc aluminum, copper aluminum nickel or iron nickel aluminum).

In an advantageous embodiment the spring made of shape memory material is the only spring within the valve. In this way, the size, the complexity and the cost of the valve can be kept low.

The shape memory material is advantageously configured such that the mechanical properties of the spring change within the temperature range in which switching between flow through the bypass and flow through the heat exchanger may be realized.

In an advantageous embodiment, the valve may be derived from a conventional spring valve wherein the conventional spring is replaced with a shape memory spring.

With increasing liquid temperature, upon surpassing a limit temperature, for example, a microstructural change in the spring material can take place which, without a counteracting force, leads to a reversible expansion of the material. The spring has thus a shape in the cold state (cold shape) and a shape in the hot state (hot shape). When expansion is prevented, the spring constant and/or the tension of the spring changes and thus the closing pressure of the valve.

In one embodiment, the spring made of shape memory material, when in the unloaded state, is longer in its hot shape than in its cold shape. In another embodiment the spring of shape memory material, when in the unloaded state, is shorter in its hot shape than in its cold shape.

In an advantageous embodiment the valve with the spring in the cold shape exhibits a minimal closing force at minimal oil temperatures below the limit temperature; at higher temperatures above the limit temperature, it has a higher closing force with the spring in the hot shape.

The valve is arranged such that for minimal temperatures, for example, when cold starting an internal combustion engine, already at minimal liquid pressure it opens or is slightly open and therefore the liquid flow is guided so as to bypass the heat exchanger through the bypass to the dirty side of the filter element.

In this way, a blocked heat exchanger does not block the entire liquid circulation. In this way, in particular an improved cold start behavior is achieved.

When in normal operation the optimal liquid temperature is reached the valve is partially or completely closed so that the entire volume flow or a large portion of the volume flow is guided through the heat exchanger. In connection with oil circulation of internal combustion engines, this happens advantageously beginning at a limit oil temperature in the range between approximately 60 to 100 degrees C., particularly advantageously between 80 and 90 degrees C. In the case of pressure increase in the liquid circulation, for example, caused by a blocked heat exchanger or pressure peaks of the oil pump, the valve will open. In this way, the valve fulfills a temperature control and pressure control function for which no action from the exterior is required.

The arrangement of the valve is realized advantageously such that the spring of shape memory material counteracts the liquid pressure at the side of the inlet. It can be arranged either upstream or downstream of the valve seat. It can be used as a pressure (compression) spring as well as a tension spring.

In one embodiment, a spring with an extrinsic two-way behavior is used. In this connection, a conventional spring can be used as a restoring spring. After cooling, this restoring spring, by its application of an external force, can restore the spring of shape memory material into its cold shape.

Advantageously, the valve is configured such that the liquid pressure alone provides the restoring force for restoring the cold shape so that in this way a restoring spring is not needed.

In an advantageous embodiment, the shape memory spring is in the form of a spring with intrinsic two-way effect so that upon cooling no external restoring force is required (for example, from another spring); instead, the shape memory material returns into its cold shape without external effects.

In one embodiment, the shape memory spring in its cold shape is not under tension so that flow is enabled already for very minimal liquid pressure.

In another embodiment, the shape memory spring in its cold shape is pretensioned in the valve so that an opening pressure must be overcome in the cold state also.

In one embodiment the opening pressure of the valve for an oil temperature below the limit oil temperature is at approximately 0 to 0.4 bar (advantageously 0.2 or 0.3 bar) and for an oil temperature above the limit temperature is at approximately 0.4 to 1.0 bar (advantageously 0.6-0.8 bar).

One embodiment proposes the use of at least two springs. They each can be embodied either as a pressure spring or a tension spring. The springs can be arranged in series and/or parallel and/or opposed. In this way, the spring properties of different springs with or without shape memory material can be combined in order to achieve the desired valve characteristic.

At least one shape memory spring can be arranged either upstream or downstream of the valve seat.

One embodiment of the invention provides that the entire valve is designed as a constructive (unitary) unit. This has the advantage that the valve outside of the mounted state can be operationally checked and can be inserted simply as an assembly into the system.

In a further embodiment in an existing pressure control valve the conventional spring is replaced with a shape memory spring. In this way, the existing heat exchanger can be retrofitted without constructive changes to the heat exchanger according to the invention.

In another embodiment the heat exchanger is part of a heat exchanger unit that further comprises a filter housing and a filter insert.

In yet another embodiment the invention includes a heat exchanger unit, in particular for motor vehicles, for cooling and filtering a liquid, having:

a) a heat exchanger element with an inlet opening and an outlet opening for the liquid to be cooled, as well as b) a bypass for bypassing the heat exchanger, and c) a valve for controlling the liquid stream through the heat exchanger and through the bypass, wherein the valve comprises at least one spring comprising a shape memory material that counteracts the liquid pressure in the inlet;

d) a filter housing that receives a filter insert with a filter element, wherein the filter insert comprises at a lower terminal disk a non-return diaphragm that divides the dirty side into an inlet chamber and an annular chamber wherein the annular chamber surrounds the filter element, wherein return flow from the annular chamber into the inlet chamber is prevented, wherein the inlet passage is connected to the inlet opening of the heat exchanger element, wherein the bypass connects the inlet passage to the inlet chamber.

In one embodiment, the filter insert includes a central tube that connects the clean side of the filter element with the outlet passage.

In another embodiment, a pressure relief valve is arranged in the central tube. Advantageously, the pressure relief valve is arranged in the area of the upper terminal disk. When the filter element is clogged, for example in case of overpressure at the dirty side, the medium to be filtered can then flow from the dirty side into the central tube.

In one embodiment the central tube projects with an axial projection beyond the lower terminal disk which projection penetrates the inlet chamber and at its end is connected seal-tightly to the outlet passage.

In another embodiment the axial projection has at its end two radial seals between which a radial outlet opening is provided through which the cleaned fluid can flow into the outlet passage, in which the first seal separates the inlet chamber from the outlet passage, and in which the axial projection in the area adjoining the radial outlet opening is configured as a closure plug that closes off an oil drain passage.

In another embodiment, the bypass extends parallel to the main axis of the filter insert. In this connection, the opening of the bypass is advantageously oriented in the direction of the filter housing lid.

This has the advantage that the bypass together with the remainder of the interior that receives the filter insert can be demolded, wherein the opening of the bypass is easily accessible. The valve is thus insertable through the generously sized opening into the filter housing in which also the filter insert is mounted.

In one embodiment, the valve is insertable as a unit into the bypass.

In yet another embodiment the filter element is configured to be pushed onto the central tube wherein the terminal disks are seated seal-tightly on the central tube.

In one embodiment the central tube is snapped into the lid of the filter housing or is connected in any other way such as to the lid such that the central tube with the pushed-on filter element is rotatable about and attached with play to the lid.

Further advantages and expedient embodiments are disclosed in the further claims, the figure description, and the drawings.

The invention concerns furthermore a method for controlling the flow through a bypass passage for bypassing a heat exchanger for lubricant oil circulation for an internal combustion engines, comprising the following method steps:

a) taking in the lubricating oil into a collecting chamber or passage from where an inlet to the heat exchanger and a bypass for bypassing the heat exchanger are branched off, b) loading a valve that comprises a spring, that is made of shape memory alloy and arranged in or upstream of the bypass, with the liquid pressure and the temperature of the liquid flowing into the collecting chamber wherein the spring of shape memory material provides the closing force of the valve counter to the liquid pressure, c) changing the spring constant and the closing force of the valve spring of shape memory material by a microstructural change that occurs when the temperature of the spring microstructure surpasses a limit temperature, d) opening or closing the valve depending on the liquid pressure and the closing pressure of the valve, wherein the closing pressure of the valve is determined by the shape memory spring and the microstructural state alone.

The invention concerns furthermore a method for retrofitting a heat exchanger or an oil cooler wherein a valve with a spring of shape memory material is integrated into the heat exchanger or the oil cooler, whereby a heat exchanger or oil cooler according to the invention is produced

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
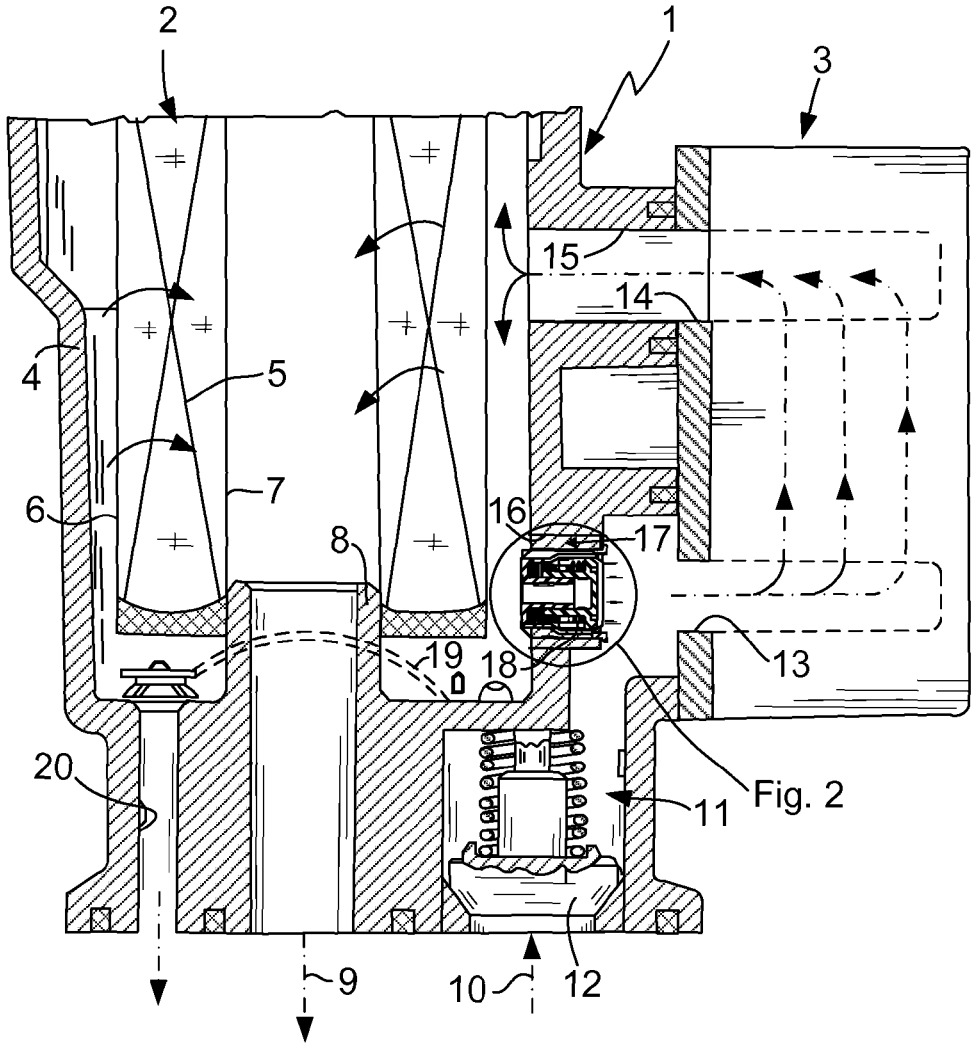
FIG. 1 discloses a section of a heat exchanger unit that can be connected by a flange to an engine block of an internal combustion engine for filtering and cooling oil.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a heat exchanger for liquid including a shape memory actuated valve in stalled to enable pressure or temperature responsive bypass of the exchanger. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 shows a heat exchanger unit 1 serving for cooling and filtering a lubricating oil in an internal combustion engine. It comprises a liquid filter 2 and a heat exchanger 3, wherein the liquid filter 2 and the heat exchanger 3 may be embodied as individual components but are fixedly connected to one another. The filter may be arranged also outside of the heat exchanger unit and may be connected to it by means of the liquid circulation. In the embodiment illustrated in FIG. 1 the liquid filter 2 has a filter element 5 arranged in a filter housing 4 and embodied as a hollow cylindrical element whose radial exterior side is the dirty side 6 with radial intake of the raw liquid to be filtered and whose cylindrical inner space is the clean side 7 from where filtered liquid is axially discharged. The filter element 5 is inserted into a receptacle in the filter housing 4 wherein the cylindrical interior of the filter element is placed onto a housing socket 8 that is part of a discharge tube for discharging the filtered liquid in the direction of arrow 9.

The dirty liquid to be filtered is supplied in the direction of arrow 10 into a supply passage 11 integrally formed in the filter housing 4 in which a check valve 12 is arranged for preventing undesirable return flow of the liquid to be filtered in a direction opposite to the direction of arrow 10. The supply passage 11 communicates with an inlet opening 13 in the housing of the heat exchanger 3 arranged laterally on the filter housing 4. In regular operation, above a switching or limit temperature of the liquid, the liquid to be filtered flows through the supply passage 11 and through the inlet opening 13 into the heat exchanger 3, is cooled therein, and flows subsequently through the outlet opening 14 in the housing of the heat exchanger 3 and a connecting passage 15 in the filter housing into the outer annular space that surrounds the filter element 5 and impinges radially on the dirty side 6 of the filter element. After having radially passed the filter element, the filtered and cooled liquid is discharged via the clean side 7 and the housing socket 8 in direction of arrow 9.

Figure 2:
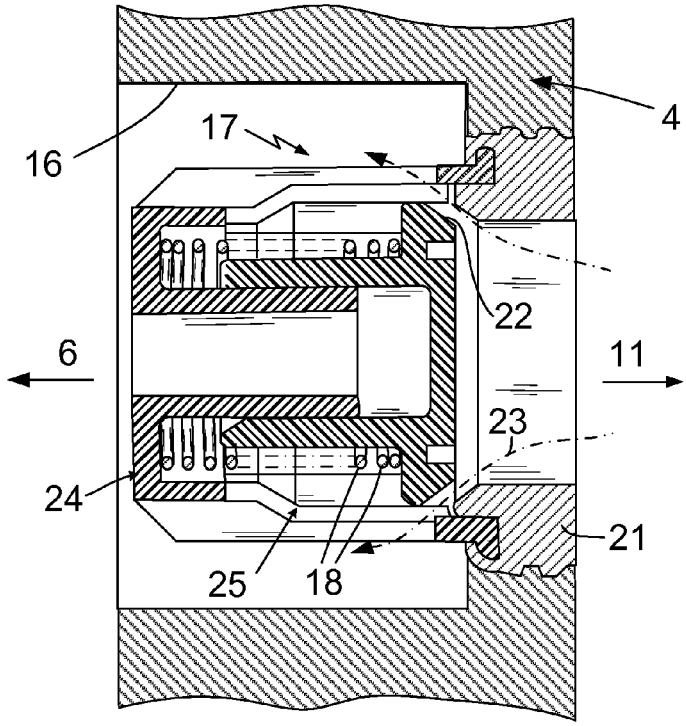
FIG. 2 discloses a section of the valve with a spring of shape memory material for use in a bypass of a heat exchanger according to the invention.
Figure 3:
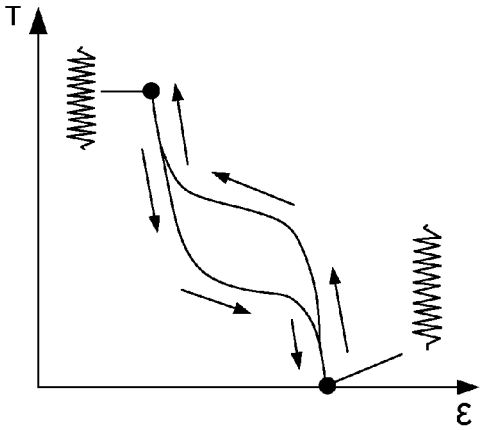
FIG. 3 shows schematically and in an exemplary fashion the expansion course of a trained material as well as the length of a spring comprised thereof with two-way shape memory behavior. The illustrated behavior can be used for a valve that closes in the pulling direction (tension) of the spring.
Figure 4:
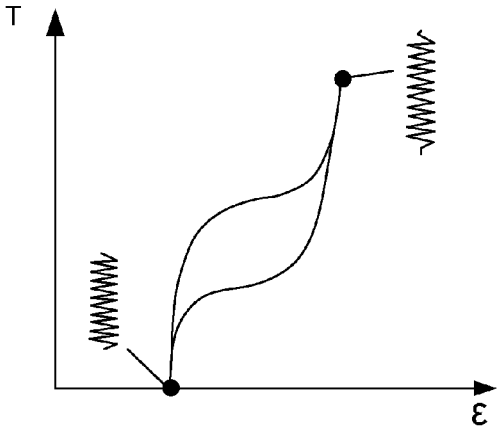
FIG. 4 shows schematically and in an exemplary fashion the expansion course of another trained material as well as the length of a spring comprised thereof with two-way shape memory behavior. The illustrated behavior can be used for a valve that closes in the pressure direction (resisting compression) of the spring.
Figure 5:
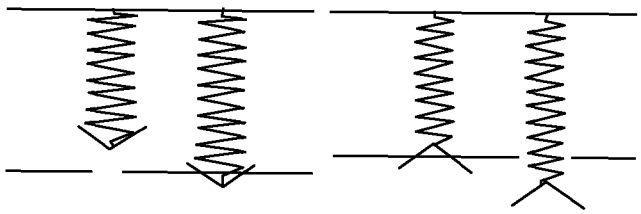
FIG. 5 shows schematically two valve variants with springs of shape memory material. On the left side, a valve is illustrated that closes in the pressure direction of the spring; on the right side, a valve that closes in the pulling direction of the spring is illustrated.

According to FIGS. 1 and 2 the supply passage 11 is connected by a bypass 16, that is provided in the wall of the filter housing and is positioned opposite the inlet opening 13 into the heat exchanger 3, immediately with the annular space that surrounds the filter element 5 as well as the dirty side 6 of the filter element. The bypass opening is to be closed and opened by a valve 17 that is arranged in the area of the supply passage 11, wherein the valve 17 comprises a spring of shape memory material 18 that when a switching temperature is surpassed or undershot changes its mechanical properties.

In FIG. 2, the valve (corresponding to valve 17 in the filter housing 4 according to FIG. 1) is shown in its open position. This spring of shape memory material 18 is clamped between valve cone 22 and valve hood 24 wherein the valve hood 24 is provided with penetrations 25 through which the oil can flow out. The liquid flow that enters through the inlet passage 11 is guided immediately in the direction of arrow 23 via the bypass 16 to the dirty side 6 of the filter element 5 by bypassing the heat exchanger 3. Below a specific switching temperature, which in case of oil filtration or oil cooling is approximately 80 degrees C., the spring of shape memory material 18 is in its cold shape. The spring 18 is designed such that in this state it is so strongly tensioned that a minimal pressure of the valve cone 22 on the valve seat 21 is generated. The valve has in this state a minimal opening pressure. In this connection, the regular liquid pressure in operation of the internal combustion engine in the cold state is sufficient for opening the valve. In this way, it can be prevented that the increased viscosity at low temperatures of the liquid to be filtered causes blockage and clogging of the heat exchanger 3. Upon surpassing the switching temperature, the microstructure of the spring 18 of shape memory material changes so that its length in the unloaded state would become greater. As a result of clamping of the spring 18 in the valve 17 and the resulting predetermined length, a higher pretension of the spring is however generated so that the spring force and thus the opening pressure of the valve will increase. Upon overpressure in the inlet passage 11 the closure force of the valve is however overcome. In this way, the bypass 16 at liquid temperatures above the switching temperature and at normal pressure conditions is closed so that the entire liquid flow is guided via the inlet opening 13 through the heat exchanger 3. At liquid temperatures below the switching temperature and normal pressure conditions the bypass is however open; likewise, at liquid temperatures above the switching temperature and simultaneous pressure peaks of the oil pump in the inlet passage 11 it is also open.

Figure 6:
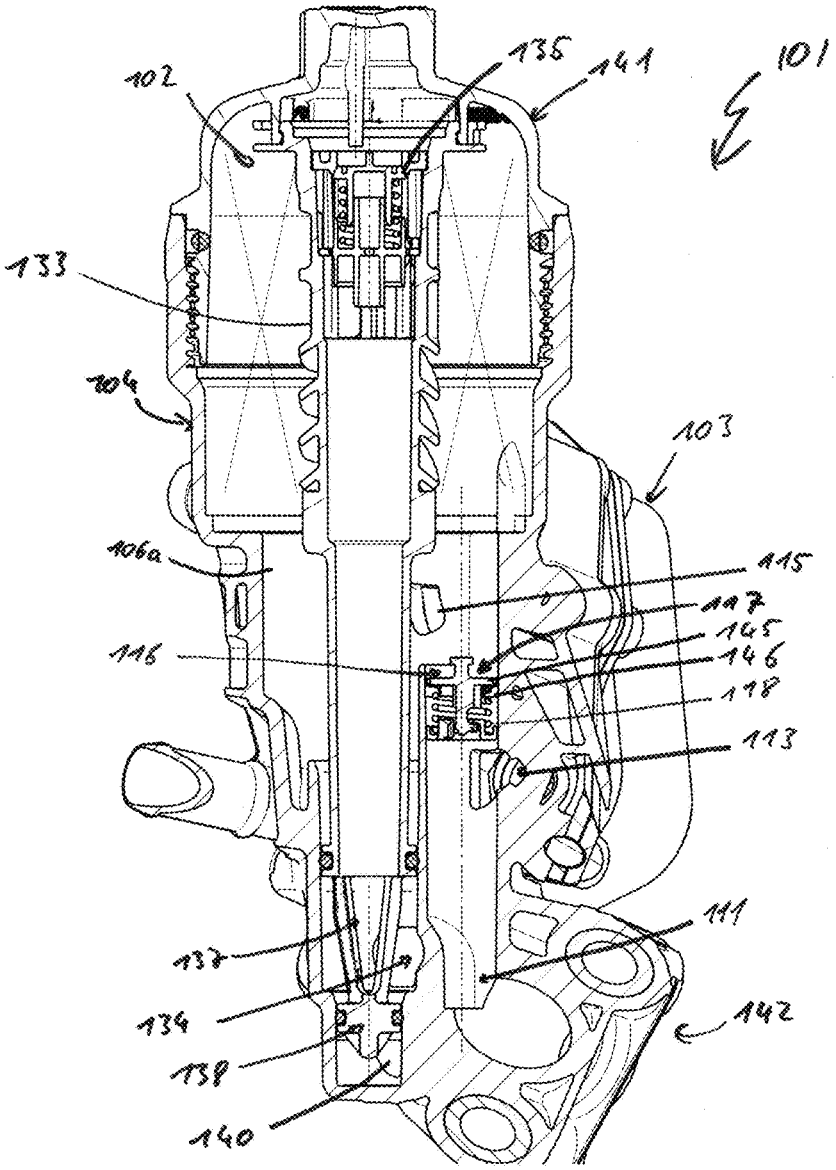
FIG. 6 shows a section view of an embodiment of a heat exchanger unit in accordance with the present invention.
Figure 7:
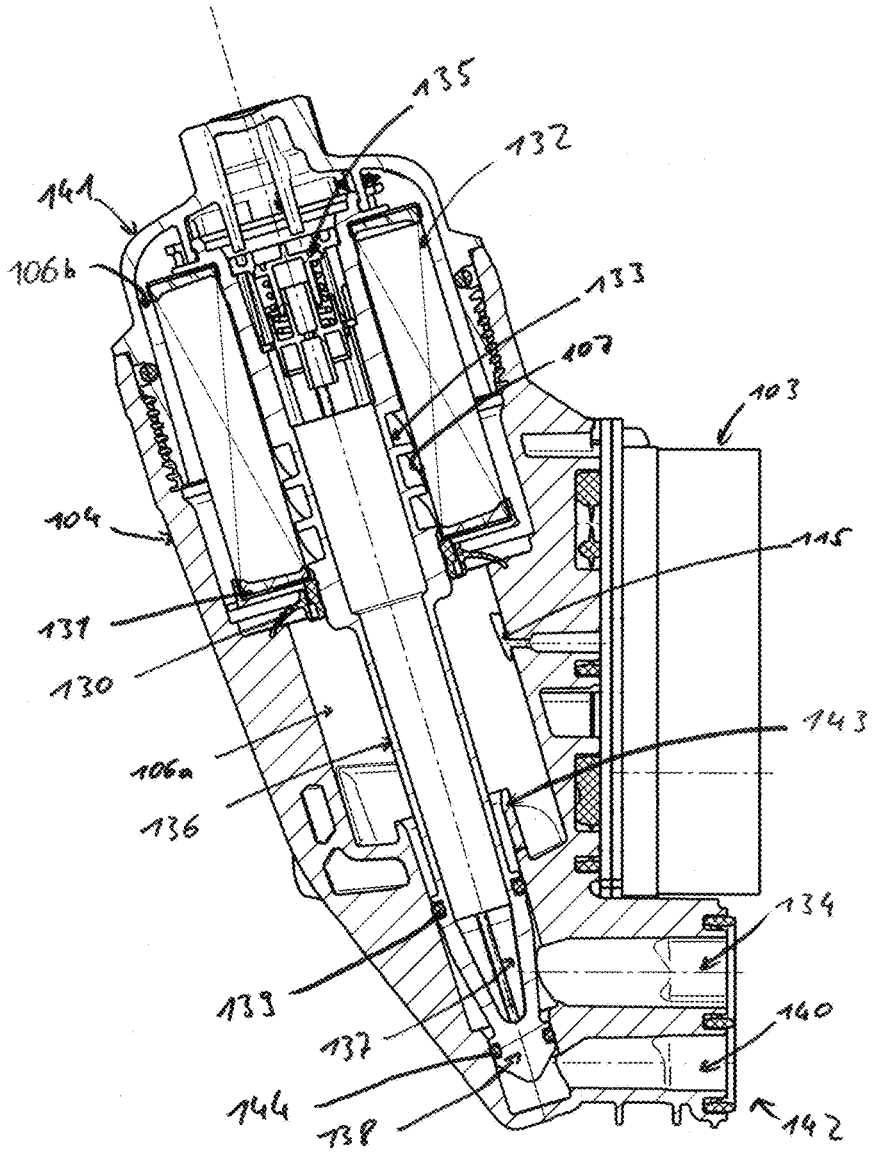
FIG. 7 shows another section view of the embodiment of a heat exchanger unit according to the invention.

FIGS. 6 and 7 show different section views of an embodiment of a heat exchanger unit 101 according to the invention. The heat exchanger unit 101 comprises a connecting flange 142 in which an inlet passage 111 is arranged through which the fluid to be purified and cooled enters the heat exchanger unit. From the inlet passage 111 the inlet opening 113 branches off toward the heat exchanger element 103. From it the fluid flows through the outlet opening 115 into the inlet chamber 106*a*. Downstream of the inlet opening 113 a bypass 116 is connected to the inlet passage 111 and in an advantageous embodiment as shown in FIG. 6 is a straight continuation of the inlet passage 111. The bypass 116 connects, by bypassing the heat exchanger element, the inlet passage 111 to the inlet chamber 106*a*. A valve 117 is arranged in the bypass 116; it comprises a single spring 118. The spring 118 is comprised of a shape memory material with intrinsic two-way effect. Upon passing through the limit temperature range at approximately 80+/−10 degrees C. the microstructure of the spring 118 changes and thus the spring constant and the opening pressure of the valve 117. The valve 117 is designed such that for fluid temperatures below the limit temperature range the opening pressure of the valve is in the range of a few tenths of a bar, in particular 0 to 0.5 bar. Accordingly, in this state the bypass 116 in operation is continuously flown through. At the same time, the heat exchanger element is also flown through. In this way, in the cold state the flow resistance of the arrangement is minimized. In the hot state, above the limit temperature range, the spring 118 has a higher spring constant wherein the valve is designed such that the opening pressure is in the range of 1 to 3 bar, advantageously in the range of 2+/−0.5 bar. The valve 117 thus acts in the hot state like a conventional radiator bypass valve.

The bypass 116 extends parallel to the main axis of the filter insert 102. The opening of the bypass is advantageously oriented in the direction of the lid 141 of the filter housing 104. This has the advantage that the bypass together with the remainder of the interior that receives the filter insert can be demolded wherein the opening of the bypass is easily accessible. The valve 117 is thus, because of the generously sized opening, insertable into the filter housing in which also the filter insert is mounted. In this connection, the valve 117 is configured as a unit and insertable into the bypass in completely assembled state.

The spring 114 is arranged on the intake side of the valve 117 and counteracts the liquid pressure existing thereat. The valve cone 145 rests on the valve seat 146 on the side opposite the spring 118 and has a projection that extends through the spring 114. The projection is connected on the side of the spring facing away from the valve seat to the spring, wherein the other end of the spring is supported on the valve seat 146. Accordingly, the spring 118 pulls the valve cone 145 opposite to the flow direction against the valve seat 146. The valve 117 is mounted in the bypass 116 in that it is pushed into the bypass. Because of the oversize of the valve seat 146 the valve is clamped tightly in the bypass 116.

In the filter housing 104 a filter insert 102 is arranged that comprises a central tube 133 and a filter element 132. The filter element 132 is pushed onto the central tube 133 and, in the area of the terminal disks, is seal-tightly connected to the central tube 133. In FIG. 6 the filter element 132 is not illustrated; its position is indicated by a large "X" on either side of the central tube. The filter element 132 has at its lower terminal disk 131 a non-return diaphragm 130 that prevents return flow of the liquid from the annular chamber 106*b* into the intake chamber 106*a*. At the end of the filter element 132 opposite the non-return diaphragm 130 the central tube 133 is provided with a pressure relief valve 135 that opens upon excess pressure in the annular chamber 106*b*, for example, in case the filter element 132 is clogged, and connects the annular chamber with the interior of the central tube 133. In case of overpressure in the system, in particular in the cold state with thick (example, viscous) lubricating liquid, the arrangement of the valves 117 and 135 and the non-return diaphragm 139 interact with one another in an advantageous manner. The valve 117 opens, and thus opens an additional flow cross-section parallel to the heat exchanger element so that in a first step the flow resistance is minimized. The subsequently flown-through non-return diaphragm 130 opens a large cross-section, in particular in comparison to a regular non-return valve, so that also at this location a minimal differential pressure is achieved. The filter element 132 that is flown through subsequently may generate in particular in case of cold thick lubricating liquid a great flow resistance that is reduced by the pressure relief valve 135 that opens for increased pressure. In addition to the fulfilled safety functions, the entire arrangement is thus also suitable, in particular in the cold state, to minimize the differential pressure of the entire system so that the emissions of an internal combustion engine that is provided with a heat exchanger unit may be reduced in the cold state, in particular when starting the engine in the cold state.

The central tube 133 has an axial projection 136 that connects the clean side 107 of the filter element with the outlet passage 134 at the connecting flange 142. The axial projection 136 projects into a socket 143 from which the outlet passage 134 and oil drain passage 140 are branched off. In this connection, the axial projection comprises at its end two radial seals between which a radial outlet opening 137 is provided through which the cleaned fluid can flow into the outlet passage 134, wherein the first seal 139 separates the inlet space 106*a* from the outlet passage 134. The axial projection is embodied in the area adjoining the radial outlet opening 137 as a closure plug 138 with a second seal 144 that closes off the oil drain passage 140.

The central tube 133 is connected to the lid 141 by a snap connection in such a way that the central tube 133 is rotatable relative to the lid 141. When the lid 141 that is connected by a screw connection to the filter housing 104 is opened, the central tube and the filter element 132 are released also at the same time. In this way, the lid 141, the central tube 133 and the filter element 132 can be removed as a unit.

When the lid 141 is released first the closure plug 138 will open so that the lubricating liquid contained in the arrangement can drain into the oil drain passage. First the already cleaned lubricating liquid that is still contained in the central tube 133 will flow out. When the lid 141 is opened farther, the first seal 139 loses contact. Then, the lubricating liquid of the inlet chamber 106*a* and the annular chamber 106*b* can drain off as well as a part of the lubricating liquid from the heat exchanger element 103. The outlet opening 115 in an advantageous embodiment is as low as possible, i.e., positioned at a height as minimal as possible, so that a volume proportion as large as possible can drain from the exchange element.

In an advantageous embodiment, the socket 143 in the area of the inlet chamber 106*a* has an opening that connects the interior of the socket 143 to the inlet chamber 106*a* (not shown here). In this way it is achieved that the inlet chamber 106*a* can drain completely even when the socket projects into the inlet chamber 106*a*.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims The invention is defined solely by the appended claims including any amendments made during the pendency of this application and all equivalents of those claims as issued.

The invention claimed is:

1. A heat exchanger assembly for cooling a liquid, comprising:

a heat exchanger include a fluid inlet and a fluid outlet for a liquid to be cooled;

a liquid filter that comprises a filter housing;

a filter element arranged inside said filter housing;

wherein said filter element has a dirty side and said dirty side communicates with said outlet, wherein said bypass connects said inlet to said dirty side of said filter element:

a bypass that bypasses the heat exchanger; and a valve controlling flow of the liquid into the heat exchanger or into said bypass;

wherein said valve has a valve seat, a valve cone, and at least one spring made of shape memory material, wherein said at least one spring counteracts a liquid pressure existing in said inlet;

wherein said valve is inserted into said bypass;

wherein said valve is configured as a unit, inserted into an open end of said bypass in a completely assembled state;

wherein the shape memory material of said at least one spring of shape memory material exhibits a change of mechanical properties in a range of approximately 60-100 degrees C.;

wherein said valve below a limit temperature of approximately 60 to 100 degrees C. has an opening pressure of approximately 0 to 0.4 bar; and wherein said valve above a limit temperature of approximately 60 to 100 degrees C. has an opening pressure of approximately 0.4 to 1.0 bar.

2. The heat exchanger assembly according to claim 1, wherein said bypass connects said inlet immediately with said outlet by bypassing the heat exchanger.

3. The heat exchanger assembly according to claim 1, comprising a liquid filter that comprises a filter housing and a filter element arranged inside said filter housing;

wherein said filter element has a clean side and said clean side communicates with said inlet, wherein said bypass connects said clean side to said outlet.

4. The heat exchanger assembly according to claim 1, comprising a liquid filter that comprises a filter housing and a filter element arranged inside said filter housing, wherein said filter element has a dirty side and said dirty side communicates with said outlet, wherein said bypass connects said inlet to said outlet by bypassing the heat exchanger.

5. The heat exchanger assembly according to claim 1, wherein said at least one spring of shape memory material has an extrinsic two-way behavior.

6. The heat exchanger assembly according to claim 5, wherein a restoring force for said at least one spring of shape memory material is provided by said liquid pressure of the liquid.

7. The heat exchanger assembly according to claim 1, wherein said at least one spring of shape memory material has an intrinsic two-way effect.

8. The heat exchanger assembly according to claim 1, wherein said at least one spring of shape memory material alone provides a closing force for said valve.

9. The heat exchanger assembly according to claim 1, wherein said at least one spring of shape memory material is the only spring of said valve for controlling said flow of liquid into said bypass.

10. The heat exchanger assembly according to claim 1, wherein said at least one spring of shape memory material has a cold shape and is not tensioned in said valve in said cold shape.

11. The heat exchanger assembly according to claim 1, wherein said at least one spring of shape memory material has a cold shape and is tensioned in said valve in said cold shape.

12. A heat exchanger unit for cooling and filtering a liquid, the heat exchanger unit comprising:

a heat exchanger element with an inlet opening and an outlet opening for the liquid to be cooled;

a bypass for bypassing said heat exchanger element; and a valve for controlling a liquid stream through said heat exchanger element and through said bypass;

wherein said valve comprises at least one spring comprised of a shape memory material and counteracting the liquid pressure in an inlet passage of the heat exchanger unit;

a filter comprising a filter housing and a filter insert with a filter element inserted in said filter housing, wherein said filter insert comprises a lower terminal disk and a non-return diaphragm arranged at said lower terminal disk, wherein said non-return diaphragm divides a dirty side of said filter into an inlet chamber and an annular chamber, wherein said annular chamber surrounds said filter element, wherein a return flow from said annular chamber into said inlet chamber is prevented; and wherein said inlet passage is connected to said inlet opening of said heat exchanger element and wherein said bypass connects said inlet passage to said inlet chamber;

wherein said bypass having said valve is arranged within said inlet passage;

wherein said bypass is parallel to a main axis of said filter insert;

wherein said bypass with said valve arranged therein is a straight continuation of said inlet passage;

wherein an open end of said bypass in said filter housing is oriented in a direction towards a lid of said filter housing;

wherein said valve is configured as a unit, inserted into said open end of said bypass in a completely assembled state.

13. The heat exchanger unit according to claim 12, wherein said filter insert comprises a central tube that connects a clean side of said filter element with an outlet passage of said filter.

14. The heat exchanger unit according to claim 13, further comprising a pressure relief valve arranged in said central tube.

15. The heat exchanger unit according to claim 13, wherein said central tube has an axial projection that extends past said lower terminal disk, wherein said axial projection penetrates said inlet chamber and is connected seal-tightly to said outlet passage.

16. The heat exchanger unit according to claim 15, wherein said axial projection has at the end facing said outlet passage a first and a second radial seals between which seals a radial outlet opening is provided through which the fluid after passing through said filter element flows into said outlet passage, wherein said first seal separates said inlet chamber from said outlet passage, wherein said axial projection in an area adjoining said radial outlet opening is configured as a closure plug that closes off an oil drain passage of said filter.

17. The heat exchanger unit according to claim 12, wherein said at least one spring of shape memory material has an extrinsic two-way behavior;

wherein a restoring force for said at least one spring of shape memory material is provided by said liquid pressure of the liquid in said inlet passage;

wherein said at least one spring of shape memory material has an intrinsic two-way effect;

wherein said at least one spring of shape memory material alone provides a closing force for said valve;

wherein said valve below a limit temperature of approximately 60 to 100 degrees C. has an opening pressure of approximately 0 to 0.4 bar;

wherein said valve above a limit temperature of approximately 60 to 100 degrees C. has an opening pressure of approximately 0.4 to 1.0 bar;

wherein the shape memory material of said at least one spring of shape memory material exhibits a change of mechanical properties in a range of approximately 60-100 degrees C.

18. A method for retrofitting a heat exchanger assembly, or a heat exchanger unit, comprising the step of:

integrating a valve with a shape memory material into the heat exchanger assembly or the heat exchanger unit, wherein the heat exchanger assembly is configured according to claim 1 or the heat exchanger unit is embodied according to claim 12.

19. A method for controlling flow through a bypass passage for bypassing a heat exchanger for liquid lubricant oil circulation of an internal combustion engine, the method comprising the steps:

taking in the lubricating oil into a collecting chamber or passage from where an inlet to the heat exchanger and a bypass for bypassing the heat exchanger are branched off;

loading a valve that comprises a spring, that is made of shape memory alloy and arranged in or upstream of the bypass, with liquid pressure and temperature of the liquid flowing into the collecting chamber wherein the spring of shape memory material provides the closing force of the valve acting counter to the liquid pressure, wherein below a limit temperature of approximately 60 to 100 degrees C. said valve has an opening pressure of approximately 0 to 0.4 bar;

changing the spring constant and the closing force of the valve spring of shape memory material by a microstructural change that occurs when the temperature of the shape memory microstructure surpasses a limit temperature of 60 to 100 C. such that said valve has an opening pressure of approximately 0.4 to 1.0 bar;

opening or closing the valve depending on the liquid pressure and the closing pressure of the valve;

wherein the closing pressure of the valve is determined by the shape memory spring and the microstructural state alone.

* * * * *